United States Patent [19]

Burkhart

[11] 4,388,168

[45] Jun. 14, 1983

[54] LOW RESISTANCE ELECTRODE SYSTEM

[75] Inventor: William H. Burkhart, Los Altos, Calif.

[73] Assignee: Smith & Denison, Hayward, Calif.

[21] Appl. No.: 153,618

[22] Filed: May 27, 1980

[51] Int. Cl.[3] ..... C23F 13/00

[52] U.S. Cl. ..... 204/196; 204/147; 405/36; 137/268; 422/261; 422/902

[58] Field of Search ..... 204/147, 148, 196, 197; 137/268; 422/261, 902; 61/13, 12

[56] References Cited

U.S. PATENT DOCUMENTS

| | | | |
|---|---|---|---|
| 2,244,322 | 6/1941 | Zoller et al. | 204/197 |
| 2,810,690 | 10/1957 | Campise et al. | 204/197 |
| 2,847,375 | 8/1958 | Murphy | 204/197 |
| 3,443,385 | 5/1969 | Vollmer | 204/148 |
| 3,458,643 | 7/1969 | Dorr | 204/196 |
| 3,461,043 | 8/1969 | Guerrant | 204/195 R |
| 3,616,354 | 10/1971 | Russell | 204/147 |
| 3,725,669 | 4/1973 | Tatum | 204/196 |
| 3,800,026 | 3/1974 | Morgan | 422/261 |

OTHER PUBLICATIONS

"Temperature Rise in Underground Impressed Current Anodes", Reprinted from Corrosion, vol. 36, No. 4, pp. 161–167, Apr. 1980.

*Primary Examiner*—T. Tung

*Attorney, Agent, or Firm*—Poms, Smith, Lande & Rose

[57] ABSTRACT

A cathodic protection anode may be provided with arrangements for continuously supplying a slightly conductive aqueous solution to the ground above the anode so that the body of earth within which the anode is located is both moist and conductive. Above each anode may be mounted a container which includes rock salt forming a saturated salt water solution, and mixing arrangements for combining the saturated salt solution and fresh water in the desired proportion to form the slightly conductive aqueous solution. A long capillary tube is employed to feed water in very small quantities to the saturated salt solution, and a much shorter capillary tube feeds greater quantities of water to the mixing device so that a metered flow of the saline solution is combined with much larger metered flow of fresh water. The fresh water inlet tube and the insulated conductor for powering the anode may be included within a single plastic conduit extending from a central location to the individual anode structures.

10 Claims, 5 Drawing Figures

LOW RESISTANCE ELECTRODE SYSTEM

FIELD OF THE INVENTION

This invention relates to cathodic protection systems and more particularly to low resistance anode assemblies for use in such systems.

BACKGROUND OF THE INVENTION

In order to prevent corrosion of underground pipes, for example pipes carrying flammable gases, it is the practice to protect these pipes by cathodic protection. Cathodic protection is achieved and rust is prevented by making the potential of underground or underwater iron or steel structures or pipes approximately 0.3 volts more negative than its native electrochemical potential with respect to the surrounding soil. In such systems, a rectifier is often used, with its negative terminal connected to the structure to be protected and its positive terminal connected to a conductive anode or a series of parallel anodes buried in the earth some distance from the structure to be protected. In this connection it is normally desirable to locate the anodes about 100 feet or so from the pipe or other structure to be protected, but in many cases a lesser distance is used in view of geographical, boundary, or other constraints.

Typically one milliampere is needed per square foot of (bare) steel to be protected. This small amount of current per square foot is more or less independent of the resistivity of the soil surrounding the structure. Thus for practical purposes the resistance between a protected structure and the soil around it may be considered constant, and the number of amperes needed to protect a given structure is constant; and must normally be accepted as a system constraint.

Typically, sufficient rectifier voltage is used to create a flow of about one ampere per square foot of anode surface. The resistance between an anode and (remote) earth is variable, depending on the dimensions of the anode and linearly upon soil resistivity. Thus, an anode which has a resistance to earth of 2 ohms in soil having a bulk resistivity of 1,000 ohm-centimeters, will have a resistance of about 40 ohms in 20,000 ohm-centimeter soil. In accordance with the well-known expression relating voltage, current, and resistance, which indicates that voltage is equal to the product of current and resistance, when the anode has a resistance of 40 ohms, to obtain 4 amperes from the anode, a voltage of 160 volts would be required. The power at a single anode would then be excessive, and the anode would overheat and fail quickly, as developed in my article entitled "Temperature Rise in Underground Impressed Current Anodes", Corrosion, Volume 36, No. 4, pages 161–167, April, 1980. To solve this problem, many anodes are normally installed in parallel when the soil resistivity is high, in order to lower the resistance, the anode temperature and the wasted power; and this practice which is generally followed is very costly. It is also noted that most of the resistance between an anode and the earth is concentrated in a shell of earth immediately surrounding the anode, with one-half of all resistance being found in a surrounding earth shell having twice the anode dimensions, and 90% being found in a shell having 10 times the anode dimensions.

In view of the fact that the anode area is usually small compared to the surface area of the metal to be cathodically protected, current density is relatively high near the anode; and because most of the anode-earth-cathode circuit resistance is in the soil immediately surrounding an anode, over 90% of the rectifier power output is typically lost in resistive heat losses in a shell of earth surrounding and close to the anode. This lost power which is proportional to the square of the current multiplied by the resistance, heats both the earth shell and the anode. The maximum current which can be safely delivered by an anode is limited by these heating losses and the thermal conductivity of the soil. In practice, corrosion engineers rarely attempt to increase soil thermal conductivity or to reduce soil resistivity to prevent overheating. Instead, they just install more anodes, with these anodes being connected in parallel and usually spaced 10 to 20 feet apart.

Attempts to deliver more amperes per anode through the use of higher voltage often result in anode failure. This may be caused by overheating, as the anode wire insulation is a thermoplastic and may be destroyed at relatively low temperatures, about 80 degrees C. to 105 degrees C., and it is also possible to boil away the water surrounding the anode.

Another cause of anode failure is the drying of the soil in the immediate area around an anode, even when the anode temperature is well below the boiling point of water. This phenomenon is known as electro-osmosis. Experiments show that with an anode and a cathode in a jar of clay mud, a direct current flow will rapidly cause drying of the mud near the anode and water saturation near the cathode. In actual practice in the field, when anodes are located in clay soil, they may carry 10 amperes for a day and then their resistance to earth will rise rapidly to 5 or 10 times its former value. This is apparently a result of this drying out phenomenon.

Summarizing, the cost of cathodic protection increases rapidly in high resistivity soils. More anodes are needed and/or more rectifier power output is needed. Raising the number of amperes per square foot of anode area often results in anode dry-out or burn-up. In practice, conservative corrosion engineers keep anode current density low, and use large numbers of anodes, with the resultant greatly increased expense.

Accordingly, the principal object of the present invention is to reduce the resistance between anodes and the surrounding earth, with the result that current costs, and the number of anodes which must be employed, are significantly reduced.

SUMMARY OF THE INVENTION

In accordance with a specific illustrative embodiment of the invention, an anode installation is provided in which a bore hole is employed which may be 15 to 25 or so feet deep and perhaps a foot in diameter. The anode is located toward the bottom of the bore hole and is backfilled with coke in the usual manner to increase the effective anode area. Above the anode in the bore hole is a container including a saturated solution of salt, and mixing arrangements whereby fresh water is mixed with a carefully controlled small quantity of the saturated salt solution and is continuously seeped into the soil above the anode. By this arrangement a large cone or cylinder of moist conductive earth surrounds the anode which is a number of feet below the source of water, and the resultant "virtual" anode has an abundant supply of conductive ions and thus has a much lower resistance than the native soil prior to salt injection.

In one specific embodiment, the container for the saturated salt solution includes rock salt in the container, which gradually dissolves, and a long capillary tube which feeds water to the tank at a very slow rate. For example, using a capillary tube having a diameter of approximately 0.012 inch, and 40 feet in length, water at six pounds per square inch pressure will pass through the tube at a rate of about one twentieth of a gallon per day. Using a second capillary tube to supply fresh water, and using about 20 to 30 inches in length, at the same six pounds per square inch, a flow of about one gallon per day will be achieved, and mixing the outputs will provide a ratio of saturated salt solution to fresh water of about one to twenty. This mixture has a resistivity of approximately 100 ohm-centimeters. Incidentally, this is a very weak salt solution, and does not even taste salty. However, the conductivity is sufficient to insure the desired low resistance in the moist body of earth which surrounds the anode.

In accordance with one feature of the invention, if desired, and particularly for very porous or sandy soil, wicking elements made of asbestos or the like may extend outwardly from the point where the solution seeps into the soil, to insure broad area moistening of the underlying soil.

In accordance with a broad view of the invention, it includes a cathode protection anode, electrical circuitry for supplying electrical current to the anode, and arrangements for maintaining the earth around the anode damp by continuously supplying a slightly conductive aqueous solution to the vicinity of said anode.

In accordance with another aspect of the invention the arrangements for supplying a conductive aqueous solution may be defined as including a tank for receiving salt, to be mounted above the anode, and two different length capillary tubes for continuously supplying fresh water at different rates. The longer capillary tube supplies water into the main part of the tank containing the salt at a very low flow rate and forces the flow of a corresponding volume of saturated solution for mixing with fresh water supplied through the shorter capillary tube at a higher rate. The resultant weak saline solution is continuously dripped into the soil.

In accordance with another subordinate aspect of the invention, both water and electricity may be supplied to the vicinity of the anode through a single conduit of insulating material, such as rigid PVC electrical conduit.

In accordance with a further broad view of the invention, a system for maintaining a substantially constant low resistance between a buried electrode and the earth includes (1) the electrode, (2) arrangements for storing a several month's supply of salt, and for dissolving the salt to produce a saturated salt solution, (3) arrangements for mixing fresh water with the saturated solution to form a dilute salt solution having a substantially constant resistivity in the range of from 50 to 2,000 ohm-centimeters, and (4) arrangements for providing a controlled flow of the dilute salt solution into the earth surrounding the electrode, to significantly reduce the resistance between the electrode and the earth.

Advantages of the present invention include the following:

1. The number of anodes which are required is significantly reduced, usually by a factor of 2 to 5.

2. The size and the cost of the rectifier and transformer in the power supply may be substantially reduced. The cost depends on the number of watts, equal to the product of the square of the current multiplied times the resistance, with the required current being constant. With the resistance being reduced, the required power, or wattage, is proportionally less.

3. The installation costs are greatly reduced. The drilling of the deep holes for anodes, and trenching to bury the wires connecting them is costly. Incidentally, as noted above, a small plastic water tube is run inside the same conduit which carries the anode wire. No additional trenching or conduit is needed to get the water to the anode installation.

4. The anode current output may be made substantially constant throughout the year despite variations, including the rainy season, irrigation, pollution by fertilizer, etc., etc. This avoids the need for frequent readjustments of the voltage to compensate for changes in anode resistance.

5. The water system, which is essentially an ion injection system, is configured so that it may be easily mounted into the 12 inch diameter hole normally drilled or bored for anode burial.

6. The system permits easy inspection to assure that the drip system is operating properly and the output solution resistivity is at the proper level.

7. The salt solution metering unit can be replaced quickly and easily by field technicians.

8. The system avoids the use of any moving parts which can fail.

9. The use of pin-hole apertures are avoided in the provision of reduced flow rates. Such pin-hole apertures can become blocked by small particles in the water supply. By using capillary tubes which have an inner diameter of approximately 0.010 inch, particles are passed which would clog a pin-hole or an almost-closed valve.

10. By the present invention the apparent anode dimensions are increased without drilling larger diameter or deeper anode holes, and without the use of additional coke backfilling.

11. Water is supplied which has the collateral advantage of preventing anode dry-out in normally moist clay soils, for example of the type found, in the San Francisco Bay area.

12. The present system has the collateral advantage of cooling the soil in areas such as Palm Springs, Riverside, Hemet, all in the state of California, and similar locations where poor soil thermal conductivity and high soil resistivity normally result in high resistance heating adjacent the anodes.

13. Engineering design is simplified through the use of a single type of anode with ion injection to provide similar results in soils of widely varying resistivities, thereby reducing the engineering time and skill required to thereby reducing the engineering time and skill required to plan a cathodic protection system. By using a single rectifier, in many cases, for each anode, and with the resistivity being substantially constant, standardization of installation and equipment, with resultant reduced costs, may be achieved.

14. By greatly reducing the amount of energy employed in heating the earth, (and) energy utilization is significantly improved.

Other objects, features, and advantages of the invention will become apparent from a consideration of the following detailed description and from the accompanying drawings.

DETAILED DESCRIPTION

Figure 1:
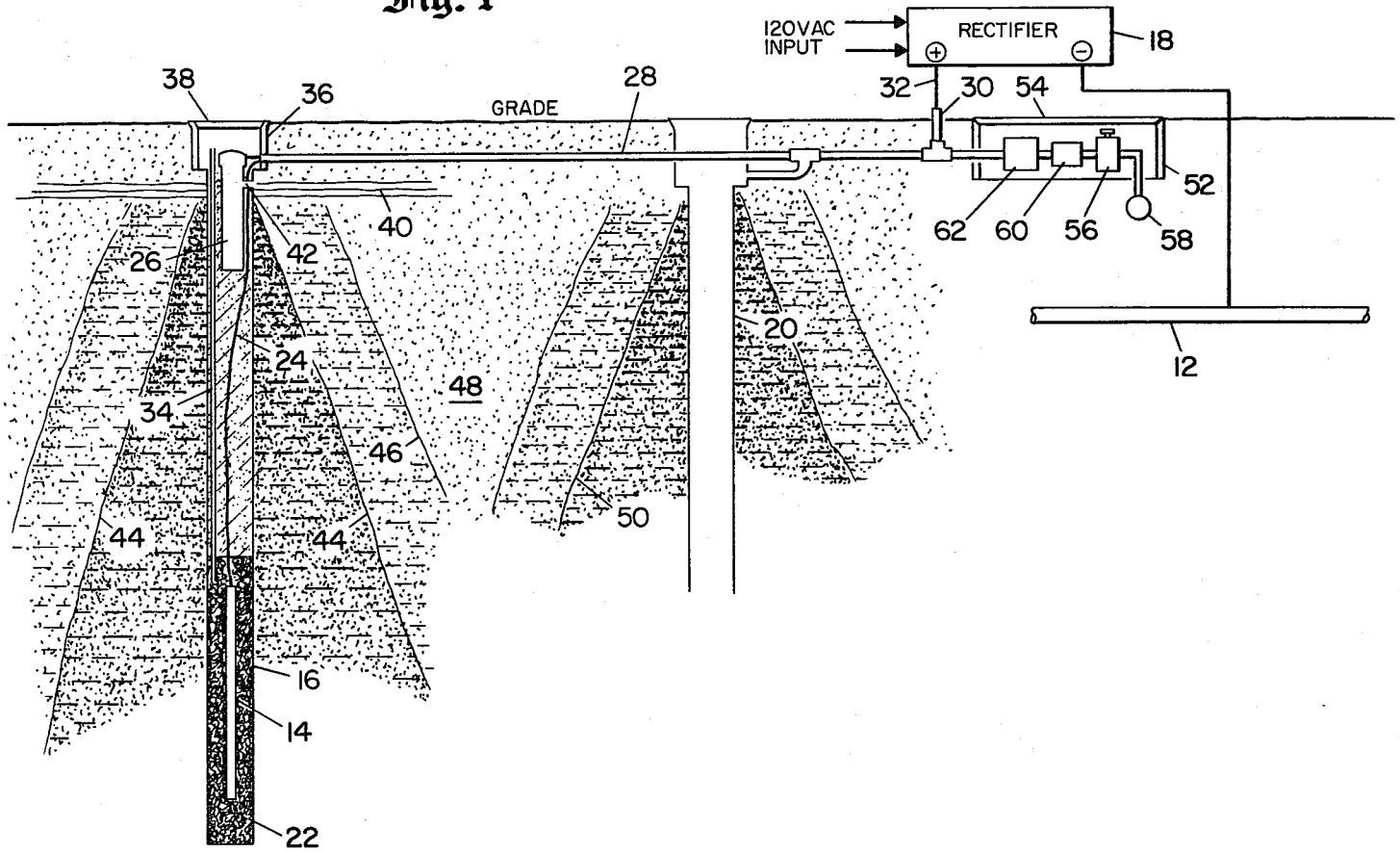
FIG. 1 is a diagrammatic showing of a cathodic protection system utilizing the principles of the present invention.

Referring more particularly to the drawings, FIG. 1 shows a pipe 12 which may, for example, be carrying gas, and which is to be protected against rusting by cathodic protection. An anode 14 is located in a hole 16, and a direct current is established by the rectifier 18 between the anode 14 and the pipe 12 which is at a negative potential and serves as the cathode in the electrical circuit.

The installation associated with the bore hole 16 will be described in some detail; however, additional bore holes and associated anode structures such as that shown schematicaly at reference numeral 20 are also included in the complete system. As discussed elsewhere, a considerable lesser number of anode installations are required using the principles of the present invention then when conventional anode systems are employed.

Now, returning to FIG. 1, after the bore hole 16 has been drilled or augured approximately 20 or 30 feet deep, and about one foot in diameter, a small amount of conductive coke 22 is initially dumped into the bottom of the bore hole 16 and then the anode is lowered into the indicated position. Additional quantities of coke are then backfilled around and somewhat above the anode 14. By way of example, the length of the anode may be approximately 5 feet, while the entire extent of the conductive coke backfill may be in the order of 7 feet. An insulated lead 24 extends from the anode 14 around the side of the salt tank 26 and through the conduit 28 back to the electrical access point 30 where connection is made via lead 32 to the positive terminal of the rectifier 18.

In addition to the conductive wire 24, a vent tube 34 may extend from the vicinity of the anode 14 up to the concrete access box 36 with its removable lid 38. This permits the free flow and venting of gases which are generated adjacent the anode 14.

Wicking 40 may be provided which extends outwardly from the point 42 where the saline solution is permitted to seep from the tank 26. This wicking may, for example, be made of asbestos or the like. It is not needed in all types of soil, but occasionally when very porous soil is encountered, such wicking is useful to insure wider distribution of the conductive ions. Shown schematically in FIG. 1 is the outer perimeter of a first cone 44 within which the soil may be quite damp, and an outer cone 46 which could be slightly moist, but still have considerably increased conductivity as compared with that of the dry soil 48 centrally located in the showing of FIG. 1. A similar cone 50 provides the virtual anode associated with the anode assembly involving bore hole 20 which is similar to that described above in connection with the bore hole 16.

Also shown in FIG. 1 is a second concrete access box 52 with its associated access lid 54. Within the box 52 are the valve and backflow prevention assembly 56 connected to the water main 58, the water filter 60 and water pressure regulator 62 which controls the pressure to about 3 to 18 pounds per square inch.

Figures 2, 3:
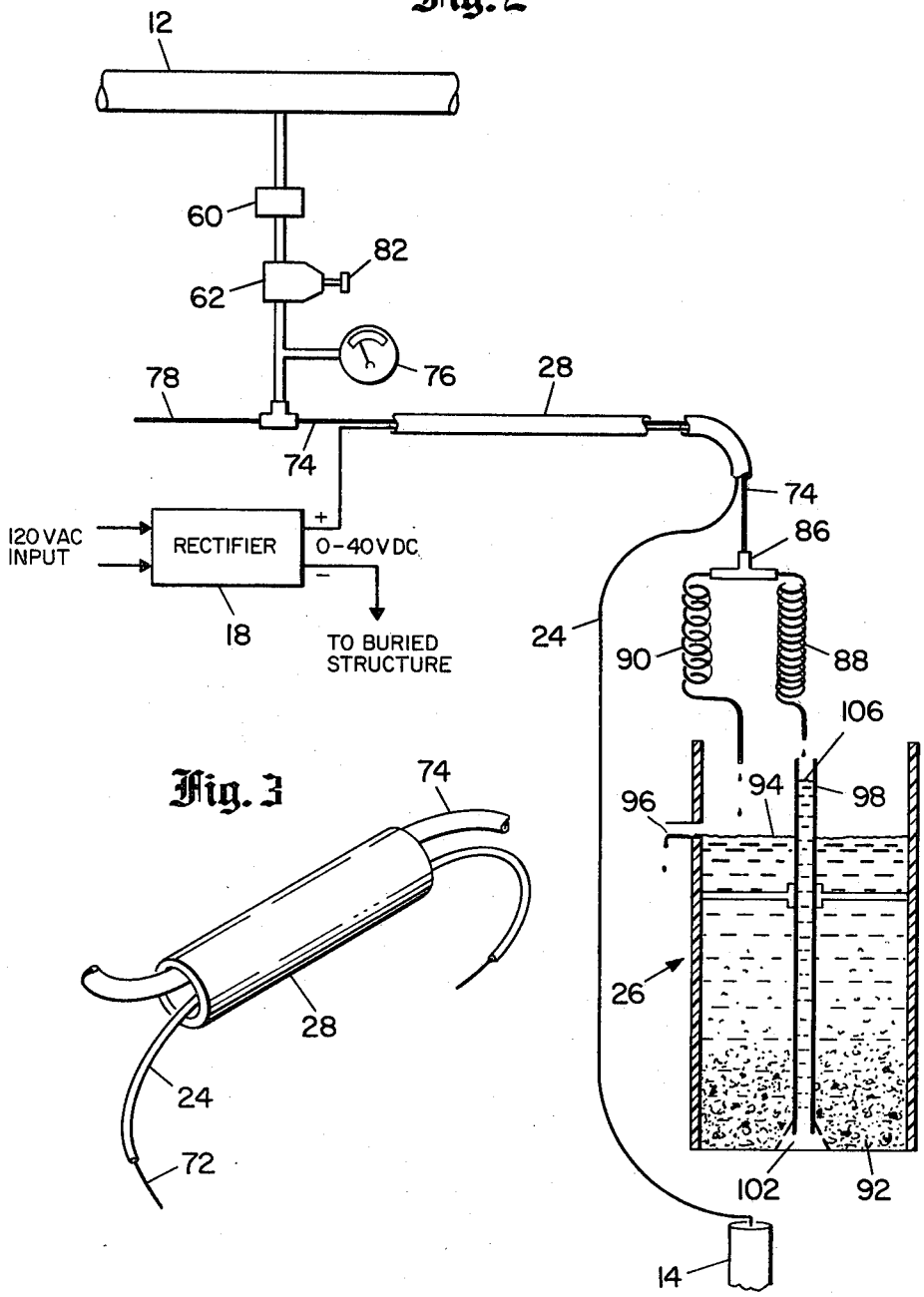
FIG. 2 is a more detailed diagram showing certain portions of the system of FIG. 1 in greater detail.
FIG. 3 is a detailed showing of a conduit carrying both the water supply in a small inner tubing and the insulated electrical conductor, leading to the anode installation.

Turning to FIG. 2, this is an enlarged showing of selected portions of the system of FIG. 1. More particularly, FIG. 2 is a more detailed schematic showing of the mode of operation of one alternative embodiment of the salt tank 26, and the conduit 28 which protects both the water and the electrical connections to the anode assembly.

Switching momentarily to FIG. 3, the conduit 28 may be made of PVC of the type normally used for low pressure water lines, and may have an inner diameter of one-half inch or three-quarters inch. Within the conduit 28 is the insulated electrical lead 24 with its central copper conductor 72, and the water tubing 74 which may have a ⅛th inch internal diameter and approximately one-quarter inch outer diameter.

A gauge 76 may be provided at the low pressure side of the pressure regulator 62 to indicate the pressure, preferably in the order of about 6 pounds per square inch, which is to be supplied to the plastic tubing 74, and via branching conduits to other anode installations, for example, through the plastic tubing 78. The output pressure from the regulator 62 may be adjusted by the adjusting knob 82.

At the salt tank 26, the water from the ⅛th inch ID tubing 74 is routed through tee fitting 86 to a first long capillary tube 88 and to a shorter capillary tube 90 as mentioned above. With a capillary tube of about 0.012 inch mentioned above. With a capillary tube of about 0.012 inch inner diameter and 6 psi, water will pass through the 40 foot long tube at a rate of about 1/20th of a gallon per day. With a similar diameter tube 90 only 20 or 30 inches long, a flow of about one gallon per day will be produced. As shown in FIG. 2, the salt tank 26 is loaded with rock salt 92, and initially filled with water to the level indicated at 94 in the vicinity of the outlet 96. An inner pipe 98 receives drops from the longer capillary tube 88, and, with the lower end of the pipe 98 open to the bottom of the brine tank at 102, the level of the salt brine is gradually increased. Water from the shorter capillary tube 90 is admitted to the upper surface 94 of the brine tank, and moves across the surface of the top of the brine to the outlet. It is understood that there is a clear demarkation line between the salt water and the fresh water. However, every drop of water which is dripped into the pipe 98, causes one drop of brine to rise and combine with the incoming fresh water and flow through the outlet 96. Therefore, the outlet emits water and brine in a ratio of about 20 to 1. It has been experimentally determined that this 20 to 1 mixture has a resistivity of approximately 100 ohm-centimeters.

Small changes made in the length of the two capillary tubes 88 and 90 will serve to alter the resistivity of the outlet water. Similarly, changing the water pressure will serve to control the number of gallons per day. I have found that three pounds per square inch gives about ½ gallon per day, 6 psi gives about 1 GPD, and ten psi gives about 2 GPD and that the 20 to 1 ratio holds reasonably constant over this pressure range. These figures depend of course on the capillary tube diameter, and involve the 0.012 I.D. capillary mentioned above.

It is also noted as mentioned above, that by using long capillary tubes, the problem of small particles plugging up tiny openings is avoided. Through the use of a filter which only permits the passage of particulate material which is much smaller than the inner diameter of the capillary tubes 88 and 90, blocking of the type frequently encountered when pin-hole or very small valve openings are used, is avoided.

It may be noted that the water level 106 at the top of the pipe 98 is substantially above the level 94 of the outlet 96, as the column of saturated brine, being relatively heavy, supports a substantially higher column of fresh water. The top 106 of the pipe 98 should be in the order of 20% of the length of the pipe above the level of the outlet 96.

As mentioned above, using a 20 to 1 ratio of fresh water to saturated salt solution, a resistivity of 100 ohm-centimeters is obtained. This corresponds to a conductivity of 0.01 mhos. With a flow rate of approximately one gallon per day, 25 pounds of salt per year would be needed, and this may be supplied once a year into the tank 26. Incidentally, a solution having a resistivity of 100 ohm-centimeters contains very little salt. It may be compared with sea water which has a resistivity of 35 ohm-centimeters. Although 100 ohm-centimeters is preferred, reasonable departures from this resistivity may be made without departing from the principles of the present invention. It is noted in passing that for a resistivity of 10 ohm-centimeters (0.1 mhos), 250 pounds of salt per year would be required; for 50 ohm-centimeters resistivity (0.02 mhos), 50 pounds of salt per year would be needed, and for a resistivity of 1,000 ohm-centimeters (0.001 mhos), 2½ pounds of salt per year would be required. As a compromise taking into account cost factors, time required for renewing the salt, and the desire to minimize pollution of the soil, the resistivity figure of 100 ohm-centimeters was selected as being the suitable order of magnitude.

Figure 4:
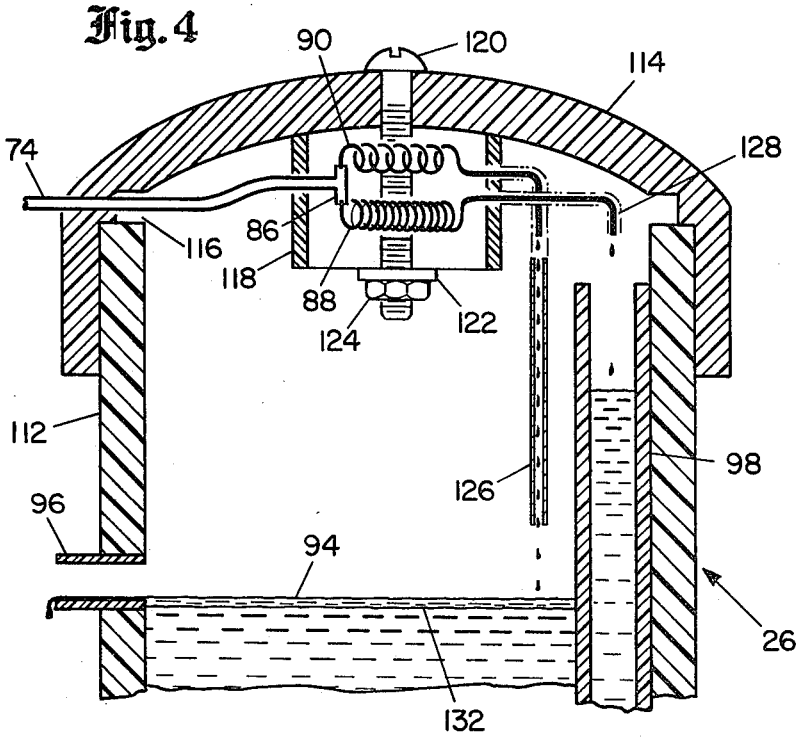
FIG. 4 is a detailed showing of one embodiment of the mixing arrangements at the top of the saline solution container.

FIG. 4 is a diagrammatic showing of one illustrative implementation of the top of a salt tank 26. The main body portion 112 of the tank 26 may be formed from 6-inch diameter PVC pipe, approximately thirty inches long, which will conveniently fit within the normal diameter of the bore hole conventionally augered for the emplacement of an anode. A conventional 6-inch PVC pipe cap 114 provides the upper cover for the salt tank assembly 26, and may be slipped over the upper end of pipe section 112. The plastic tubing 74 is brought in through a hole which is drilled in the side of the cap 114 and through a notch at point 116 in the upper periphery of the 6-inch PVC pipe section 112. A short section of two inch PVC pipe 118 is held in the upper center of the cap 114 by the retaining screw 120, a transverse bridging member 122 and a nut 124. The two capillaries 88 and 90, 40 feet in length, and two or three feet in length, respectively, are wound on a spool within the two-inch pipe 118, and are connected to the 1/16th inch diameter brass tubes 126 and 128 which are mounted in holes through the short section of pipe 118. Water flows through tube 126 to the upper surface 94 of the water at a rate of approximately one drop per second, or one gallon per day. Water flows through the longer capillary tube and into the downwardly extending PVC pipe 98 at a rate of approximately three drops per minute, or one-twentieth of a gallon per day. In addition to the upper surface level 94, the film barrier level 132, which is believed to exist between the fresh water and the salt water is also shown in FIG. 4. To the extent that water is dripped through tube 128 into the vertical tube 98, salt water is fed up to combine with the fresh water, and the dilute solution flows out through the outlet 96.

Figure 5:
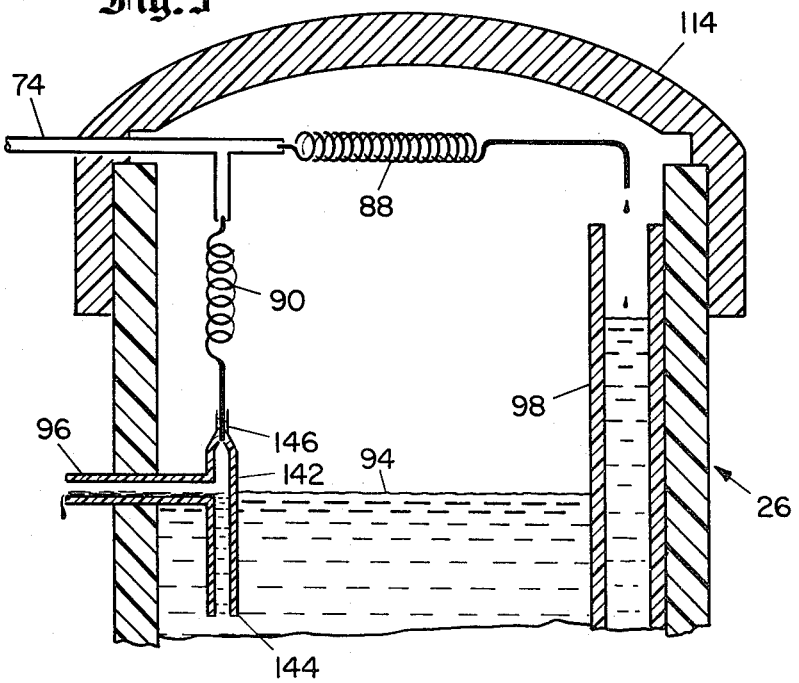
FIG. 5 is a showing of an alternative version of the brine tank and mixing arrangements.

FIG. 5 shows a slightly modified version of the salt tank of FIGS. 1, 2 and 4. Specifically, instead of using the entire surface 94 of the salt tank 26 as a mixing chamber, the mixing of the fresh water with the salt water is accomplished in a small bore tee 142 which is open to the saturated salt solution at its lower end 144 and which is connected to the shorter capillary 88 at its upper end 146. The mixed solution passes out through the output 96. With a relatively small inner bore in the order of 1/8th inch in diameter in the tee fitting 142, increased uniformity of output solution resistivity is obtained as compared with conditions where the entire upper surface 94 of the salt tank is employed for mixing.

Incidentally, the standardization which is possible with the present invention is an important feature of the invention. With the disclosed installation providing a relatively constant resistance to the earth, by using a separate standardized rectifier to supply each anode, the need for a special engineering design and special electrical components for each installation is avoided. It is noted in passing that the showing of FIG. 2 may be of such a standardized installation, with a single rectifier 18 supplying a single anode installation.

Now that the detailed description has generally been completed, some general observations will be undertaken. More specifically, it is desired that the "virtual" anode of damp or moist soil surrounding the anode be in the order of 10 feet in diameter, because 90% of all anode resistance to earth will be in a shell of this diameter. Of course, significant improvement over the present practice will be obtained with lesser diameters. As noted above, with appropriate soil conditions the water will form a cone having an outer diameter in the vicinity of the lower anode which is approximately 10 feet or more in diameter. In very porous soils, however, it may be desirable to use spreading arrangements such as a wick to distribute the moisture in a wider area than would otherwise occur.

One prior proposed arrangement which is worthy of note is disclosed in U.S. Pat. No. 3,616,354 to Mr. Gordon I. Russell. In the arrangements shown by Mr. Russell, one or more anodes are suspended wholly within a pipe which is filled with an electrolyte such as water with salt or potassium chloride in it. The pipe is disclosed as being relatively deep, for example, 100 to 200 feet deep, and the anodes are located in the pipe opposite preselected geological strata of relatively high conductivity. It is disclosed that the water and electrolyte may be periodically replenished, but there is no continuing supply of water or salt to the assembly. In addition, each installation apparently must be specially engineered following a study of core samples to determine the geological strata under consideration in the particular location. The structure is of course different too, in that a solid outer pipe with periodic perforations is employed to enclose both the solution and the electrolyte, unlike the present arrangements in which the anode is buried near the surface at a moderate depth and the conducting aqueous solution is seeped into the ground above the anode, and no impervious outer pipe is used. Accordingly, the installations of the present invention are emininently suitable for standardized installations, thereby minimizing special engineering effort, while the arrangements of Russell would appear to require very expensive special deep anode installations with corresponding very special engineering effort to determine the location of high conductivity soil strata and the like. In addition, the maintenance efforts associated with the Russell arrangements would be substantial, particularly if wide variations in resistance were not to occur. And even with monthly trips, for example, to replenish the electrolyte, considerable variations in resistivity could be expected in the interim.

In conclusion, it is to be understood that the foregoing detailed description and the accompanying drawings merely refer to one illustrative embodiment of the invention. Various modifications and changes could be implemented without departing from the spirit and scope of the invention. For example, instead of using a solution of ordinary salt, potassium chloride or other similar salt could be employed, and the term "salt" as used herein shall incompass all such salts. Also, while it is preferred that the salt tank fit directly into the normal one foot bore employed in the emplacement of anodes, a somewhat larger or different shaped tank could of course be used. Further, instead of the particular mixing arrangements disclosed, other techniques for producing a solution of the desired resistivity may be utilized. Also, the principles as set forth herein are applicable to the reduction in the resistance between electrodes and ground for systems other than cathodic protection systems. It is to be understood, therefore, that the present invention is not limited to that precisely as shown and described.

What is claimed is:

1. A system for maintaining a substantially constant low resistance between a buried electrode and the earth comprising:

at least one electrode;

means for storing a several month's supply of salt;

means for dissolving said salt to produce a saturated solution;

means for mixing fresh water with said saturated solution so as to form a dilute salt solution;

said mixing means including long capillary tube means for controlling the flow of said saturated salt solution, and short capillary tube means for controlling the more rapid flow of fresh water to be mixed with said saturated salt solution;

means for controlling both the rate of flow of the dilute solution and its salt content so as to produce a salt solution having substantially constant resistivity in the range from 50 to 2,000 ohm-centimeters; and means for distributing said salt solution to the earth surrounding said electrode to thereby substantially reduce the resistance between said electrode and the earth.

2. A system as defined in claim 1 wherein said means for storing salt includes a tank having a maximum transverse dimension less than one foot whereby it will readily fit within a normal bore for the installation of a cathodic protection anode.

3. A system as defined in claim 1 further comprising electrical conductor means for supplying direct current to said electrode, flexible plastic tubing to supply fresh water to said salt storage means, and conduit means for enclosing and protecting both said electrical conductor means and said flexible tubing.

4. A system as defined in claim 1, further comprising:

means for supplying fresh water to said storage means and to said mixing means;

means for regulating the pressure of said fresh water.

5. A low resistance system as defined in claim 1 further comprising means for directing said conductive aqueous solution away from said storage means to form a larger virtual electrode around said electrode.

6. A low resistance system as defined in claim 5 wherein said solution directing means includes wicking means extending radially outward from the distributing means to provide a large diameter virtual electrode around said electrode.

7. A constant lower resistance cathodic protection system as defined in claim 1 further comprising a standardized power supply means including a rectifier to apply a positive potential to said electrode as an anode.

8. A system as defined in claim 1 wherein said means for storing salt includes a tank having an outlet for the constant resistivity salt solution near the top of said tank, and a closed tube or pipe means extending from a level above said outlet to supply fresh water to a point near the bottom of said tank, and means for supplying fresh water through said long capillary to said pipe to form brine filling said tank and to very slowly raise the level of said brine, and means for supplying fresh water through said short capillary to the surface of said brine of the level of said outlet, whereby a dilute solution is formed and distributed from said outlet with the concentration depending on the rate of flow through said two capillary tubes.

9. A low resistance cathodic protection system as defined in claim 1, wherein said system includes a buried structure to be protected; a plurality of said electrodes and rectifier means for applying a negative voltage to said structure to be protected and a positive voltage to said electrodes in parallel to form anodes, and for supplying power at a level significantly lower than that which would normally be required in dry, high resistance soil.

10. A low resistance cathodic protection system for use in high resistance earth conditions, as defined in claim 1 including a plurality of electrodes, means for applying a positive voltage to said electrodes to form anodes, said anodes being spaced apart by at least 25 feet.

* * * * *